United States Patent [19]

Glover et al.

[11] Patent Number: 4,505,747

[45] Date of Patent: Mar. 19, 1985

[54] STABILIZING INOCULENT FOR GRAY IRON

[75] Inventors: William D. Glover, Northville, Mich.; Michael J. Lalich, Downington, Pa.

[73] Assignee: Foote Mineral Company, Exton, Pa.

[21] Appl. No.: 562,044

[22] Filed: Dec. 16, 1983

Related U.S. Application Data

[63] Continuation of Ser. No. 420,851, Sep. 21, 1982, abandoned.

[51] Int. Cl.[3] ..... B22F 1/00; C22C 33/08

[52] U.S. Cl. ..... 75/251; 75/130 R

[58] Field of Search ..... 75/130 R, 251

[56] References Cited

U.S. PATENT DOCUMENTS 3,841,847 10/1974 Jones ..... 420/428

OTHER PUBLICATIONS

Technical Data Bulletin 226-B, Foote Mineral Company, Exton, Pennsylvania, Oct. 1979.

Brochure entitled V-5 Foundry Alloy, Vanadium Corporation of America, dated prior to Sep. 21, 1981.

*Primary Examiner*—Peter D. Rosenberg

*Attorney, Agent, or Firm*—Howson and Howson

[57] ABSTRACT

A stabilizing inoculant for gray iron which increases the tensile strength thereof while reducing chill containing as essential elements chromium, silicon, and rare earths (primarily cerium).

8 Claims, No Drawings

STABILIZING INOCULENT FOR GRAY IRON

This application is a continuation of application Ser. No. 420,851, filed Sept. 21, 1982 now abandoned.

DESCRIPTION

Foundrymen have long recognized the value of adding special additives to gray iron to modify structure and control properties. These additives which are introduced late in the processing of gray iron, ensure that the graphite present in the iron is of the desired type and size by improving nucleation in the molten phase, thus preventing undercooling and formation of iron carbides, commonly called "chill," during solidification. The addition of such special additives is called inoculation and is to be differentiated from true alloying in which elemental additives are made to alter the properties of the metal matrix by mechanisms such as solid solution strengthening, precipitation strengthening, and the like.

Tensile strength of gray iron is enhanced by lowering carbon equivalent and increasing alloy content, both steps increase the propensity for chill. Accordingly, most inoculants are added to gray iron primarily to control chill, and have little effect on tensile stength.

For some years there has been available commercially a chromium-silicon-manganese inoculant the purpose of which is to provide grain refining and improved mechanical properties, such as tensile strength, while reducing chill in gray iron. Although such alloy has been considered to be an effective inoculant by the foundry industry, it is expensive, making its use rather limited.

There has also been sold to the foundry industry for gray and ductile irons a cerium-silicon alloy, which in gray iron promotes the formation of the proper graphite flake structure and minimizes chill. This alloy is said to be particularly effective in thin section castings which contain small amounts of residual elements such as chromium, molybdenum and vanadium.

For some time there has been the need for a relatively inexpensive inoculant which will improve mechanical properties of gray iron while reducing chill.

SUMMARY OF THE INVENTION

Broadly the invention resides in a novel stabilizing inoculant for gray iron which increases the tensile strength of gray iron while at the same time reduces chill. The inoculant contains as essential constituents chromium, silicon, rare earths, primarily cerium, and may also contain small amounts of such elements as aluminum and calcium, with the balance essentially iron. The inoculant may be in the form of an alloy composed of the several essential elements, or a mixture of particles of a ferrochromium alloy and a rare earth (cerium)-silicon alloy.

It was discovered that the stabilizing inoculant of this invention maintains relatively low chill severity numbers in gray iron, while at the same time substantially increasing the tensile strength of such iron by reason of the addition of increased amounts of chromium through use of the inoculant. This result was particularly surprising in view of the fact that the same result is not obtained when a gray iron containing charged chromium is inoculated with an alloy containing rare earths, primarily cerium, silicon and iron.

DETAILED DESCRIPTION OF THE INVENTION

The stabilizing additive of the invention comprises:

TABLE I

| Element | Weight Percent |
|---|---|
| Chromium | 50 to 70 |
| Rare earths | 1 to 5 |
| Silicon | 5 to 10 |
| Aluminum | up to 1.0 |
| Calcium | up to 1.0 |
| Carbon | up to 5 |
| Iron | Balance |

The chromium content of the alloy can be varied substantially even somewhat outside the above ranges, depending upon the final chromium content of the iron which is desired.

Preferred inoculants of this invention have the following composition:

TABLE II

| Element | Weight Percent |
|---|---|
| Chromium | 51 to 56 |
| Rare earths | 2.5 to 3.5 |
| Silicon | 7 to 9 |
| Aluminum | up to 0.5 |
| Calcium | up to 0.5 |
| Iron | Balance |

Preferably, cerium comprises the major portion of the rare earths. It is particularly preferred that cerium comprise about 90 percent, by weight of the rare earths.

The inoculant may be in the form of a single alloy comprised of all of the essential elements listed in the above tables, or may comprise a physical mixture of two alloys, one being a ferrochromium alloy, and the other being a rare earth-silicon alloy. Where the inoculant is in the form of a single alloy, it may be obtained by melting together those proportions of the ferrochromium and rare earth-silicon alloys which result in an alloy having the composition set forth in Table I, above. The inoculant in alloy form also may be obtained by combining the essential elements using techniques well known to skilled metallurgists.

The ferrochromium alloy, whether employed in preparing the inoculant in the form of an alloy or as a mixture with a rare earth-silicon alloy should have the composition given in Table III, below:

TABLE III

| Element | Weight Percent |
|---|---|
| Chromium | 60 to 75 |
| Silicon | up to 3 |
| Manganese | up to 1 |
| Carbon | up to 6 |
| Iron | Balance |

The rare earth-silicon alloy should have the following composition:

TABLE IV

| Element | Weight Percent |
|---|---|
| Rare Earths | 10 to 15 |
| Silicon | 36 to 40 |
| Aluminum | up to 1 |
| Calcium | up to 1 |
| Iron | Balance |

By combining the ferrochromium alloy and rare earth-silicon alloy of Tables III and IV, respectively, in the weight ratio of from about 3:1 to about 5:1, the inoculant of this invention may be obtained in either the form of a single alloy or a mixture of the two other alloys.

Where the inoculant is in the form of a mixture of ferrochromium alloy and rare earth-silicon alloy, the particles of the respective alloys should be substantially uniformly blended and should have a particle size such that 100 percent thereof pass through a ¼ inch (6.4 mm) mesh screen. Also, when the inoculant is in the form of an alloy, the alloy should comprise particles of a size similar to that of the mixture of ferrochromium and rare earth-silicon alloys.

In order to obtain significant increases in the tensile strength of gray iron, from about 0.1 to about 2 percent by weight, of the inoculant, whether in the form of an alloy or mixture, based on the weight gray iron, should be used. Preferably, the amount added should be from about 0.25 to about 1 percent.

Ordinarily the gray iron to which the inoculant is added will have a carbon equivalent which ranges from about 3.6 to about 4.3. With such iron, the increase in tensile strength can be expected to vary between about 2000 and about 10,000 psi (1.4 and 7.0 kg./mm.$^2$).

The inoculant is quite soluble and can be added in the spout through a funnel or in the ladle. The quantity required will depend upon the base composition of the iron and the extent and the type of improvement desired.

In order that the invention may be better understood, several examples thereof will now be described purely by way of illustration, without suggestion that the scope of the invention is limited to the details thereof.

EXAMPLE I

A stablizing inoculant of the present invention was prepared by combining 80 parts, by weight of a ferrochromium alloy of the composition given in Table V, with 20 parts of a cerium-silicon alloy having the composition set forth in Table VI.

TABLE V

| Element | Weight Percent |
|---|---|
| Chromium | 73.23 |
| Manganese | 0.20 |
| Silicon | 0.02 |
| Carbon | 0.06 |
| Iron | Balance |

TABLE VI

| Element | Weight Percent |
|---|---|
| Cerium | 11.81 |
| Other Rare Earths | 1.63 |
| Silicon | 35.99 |
| Calcium | 0.25 |
| Aluminum | 0.66 |

TABLE VI-continued

| Element | Weight Percent |
|---|---|
| Iron | Balance |

The particle size of the ferrochromium alloy and that of the cerium-silicon was ¼ inch (6.4 mm) by down. The alloys were mixed to form a substantially uniform blend.

0.5, 0.75 and 1.0 percent, by weight, of the inoculant were added to separate 100 pound (45.4 kg) portions of molten gray iron. Each portion was then tested for tensile strength and analyzed for composition. Chill severity number was determined employing the following method. The chilling tendency of an iron was determined by measuring the chill depth in the 1.25 inch (31.75 mm) chill wedge and by examining the series of 4 inch (101.6 mm) long pins from each chill pin set. Each chill wedge was broken exactly 2 inches (50.8 mm) from the end opposite the base and chill depth was reported in millimeters. The chill pins, which had the following diameters: 0.125 (3.175), 0.175 (4.445), 0.25 (6.35), 0.3125 (7.9375), 0.375 (9.525), 0.50 (12.7), 0.625 (15.875) and 0.825 (20.995) inches, were broken in their exact centers and severity of chill was reported for each pin as either clear, mottled or gray.

Chill data was coded so chill severity for each heat could be represented by a single number. This was accomplished by adding the clear chill depth from the chill wedge to assigned values for the clear and mottled chill pin samples. For the 0.125 inch (3.175 mm) chill pin, clear chill was arbitrarily assigned the value of 3, mottled-1, and grey-zero. The value of clear and mottled chill was increased by one unit for each increase in chill pin diameter. Thus, it follows that the assigned values for clear chill for the 0.175 (4.445), 0.250 (6.35) and 0.3.3 (7.9502) inch pins were 4, 5 and 6, respectively. The results obtained are set forth in Table VII below. An uninoculated iron was used as the control.

TABLE VII

| Quantity of Inoculant Used | Final Iron Composition | | Chill Severity | Tensile Strength, ksi | | |
|---|---|---|---|---|---|---|
| Weight Percent | CE | Cr % | Number | Predicted | Actual | Diff |
| 0.0 | 3.75 | 0.25 | 42 | 37.9 (26.7)* | 36.9 (25.9)* | −1.0 (−0.8)* |
| 0.5 | 3.82 | 0.60 | 18 | 41.2 (29.0)* | 44.4 (31.2)* | +3.2 (+2.2)* |
| 0.75 | 3.79 | 0.68 | 16 | 42.5 (29.9)* | 45.6 (32.1)* | +3.1 (+2.2)* |
| 1.0 | 3.93 | 0.77 | 20 | 39.5 (27.8)* | 46.5 (32.7)* | +7.2 (+4.9)* |

*Kg/mm.

As can be seen by reference to Table VII, the chill severity number of the uninoculated iron was very high—42—, whereas all of the irons inoculated with the new inoculant had low chill severity numbers in the range of 16 to 20, regardless of the amount of chromium added. Also, tensile strengths were increased substantially in the irons inoculated wth the inoculant of this invention. Thus, for example a Grade 40 iron was improved to a Grade 45 iron by addition of the novel inoculant.

EXAMPLE II

The inoculant of this invention in alloy form was prepared by melting a mixture of a ferrochromium alloy and a cerium-silicon alloy. This new alloy had the composition given in Table VIII, below:

TABLE VIII

| Element | Weight Percent |
|---|---|
| Chromium | 58.90 |
| Silicon | 26.40 |
| Cerium | 6.72 |
| Other Rare Earths | 0.49 |
| Aluminum | 1.08 |
| Calcium | 1.24 |
| Iron | Balance |

The alloy was crushed to a particle size of ¼ inch (6.4 mm) by down, and 0.5 and 1.0 percent portions thereof were added to separate 100 pound (45.4 g) lots of a gray iron. An uninoculated portion of the same gray iron was used as the control. Samples of the uninoculanted and inoculated iron were tested for tensile strength and analyzed for composition, and chill severity numbers were determined therefor. The results of these tests are set forth in Table IX, below:

TABLE IX

| Quantity of Inoculant Used | Final Iron Composition | | Chill Severity | Tensile Strength | | ksi |
|---|---|---|---|---|---|---|
| Weight Percent | CE | Cr % | Number | Predicted | Actual | Diff |
| 0.0 | 4.34 | 0.21 | 21 | 29.6 (20.8)* | 33.1 (23.3)* | +3.5 (+2.5)* |
| 0.5 | 4.43 | 0.34 | 7 | 27.2 (19.1)* | 37.1 (26.1)* | +9.9 (+7.0)* |
| 1.0 | 4.44 | 0.51 | 8 | 29.6 (20.8)* | 33.1 (23.3)* | +3.5 (+2.5)* |

*Kg/mm

As can be seen by reference to the data in Table IX, like the mixtures of Example I, the inoculant of this invention, in the alloy form, provides for substantial increases in tensile strength and substantial reductions in chill severity number, as compared to the control, even with increases in chromium content in the iron.

EXAMPLE III

For comparative purposes, 0.3 percent of the cerium-silicon alloy of Table VI, were added to each of two separate 100 pound (45.4 kg) batches of the uninoculated gray iron identified in Example I. The particle size of the ferroalloy was ¼ inch (6.4 mm) by down. In one instance no additional chromium was added to the gray iron, whereas in the other, chromium was added during melting of the iron. Each iron sample was analyzed for cerium and chromium content, and tensile strengths and chill severity numbers were determined therefor. The results obtained are given in Table X, below:

TABLE X

| Quantity of Inoculant Used | Final Iron Composition | | Chill Severity | Tensile Strength | | ksi |
|---|---|---|---|---|---|---|
| Weight Percent | CE | Cr % | Number | Predicted | Actual | Diff |
| 0.0 | 3.75 | 0.25 | 42 | 37.9 (26.7)* | 36.9 (25.9)* | −1.0 (−0.8)* |
| 0.3 | 3.90 | 0.26 | 19 | 39.1 (27.5)* | 40.1 (28.2)* | +1.0 (+0.7)* |
| 0.3 | 3.91 | 0.50 | 29 | 40.9 (28.8)* | 38.5 (27.1)* | −2.4 (−1.7)* |

*Kg/mm

The data in Table X show that both the uninoculated iron and the iron alloyed with chromium during melting have high chill severity numbers, 42 and 29, respectively. Thus, the addition of the chromium separate from the cerium-silicon alloy does not produce the advantageous results provided by the inoculant of this invention, namely, substantially increased tensile strength with concurrent substantial reduction in chill severity numbers.

We claim:

1. An inoculant for gray iron comprising from about 50 to about 70 percent chromium, from about 1 to about 5 percent rare earths, the major portion of which is cerium, from about 5 to about 10 percent silicon, up to about 1 percent aluminum, up to about 1 percent calcium, up to about 5 percent carbon, and balance iron, said percentages being by weight, based on the total weight of the inoculant.

2. The inoculant of claim 1 in the form of an alloy.

3. The inoculant of claim 1 in the form of a mixture of a ferrochromium alloy and a rare earth-silicon alloy, the weight ratio of the former to the latter being in the range of from about 3:1 to about 5:1, said ferrochromium alloy comprising chromium and iron and said rare earth-silicon alloy comprising rare earths, predominantly cerium, silicon and iron, the proportions of said elements in said alloys being such as to provide the composition of claim 1.

4. An inoculant alloy according to claim 2 in the form of a particulate composition in which the particle size of said alloy particles of which said composition is comprised is such that 100 percent passes through a ¼ inch (6.4 mm) screen.

5. An inoculant comprising from about 51 to about 56 percent chromium, from about 2.5 to about 3.5 percent rare earths, about 90 percent by weight of which is cerium, from about 7 to about 9 percent silicon, up to about 0.5 percent aluminium, up to about 0.5 percent calcium, and balance iron, said percentages being by weight, based on the total weight of the inoculant.

6. The inoculant of claim 5 in the form of an alloy.

7. The inoculant of claim 5 in the form of a mixture of a ferrochromium alloy and a rare earth-silicon alloy, the weight ratio of the former to the latter being in the range of from about 3:1 to about 5:1, said ferrochromium alloy comprising chromium and iron and said rare earth-silicon comprising rare earths, predominantly cerium, silicon and iron, the proportions of said elements in said alloys being such as to provide the composition of claim 5.

8. An inoculant according to claim 6 in the form of a particulate composition in which the particle size of said alloy particles of which said composition is such that 100 percent passes through ¼ inch (6.4 mm) screen.

* * * * *